United States Patent [19]

Sendl et al.

[11] Patent Number: 4,475,454

[45] Date of Patent: Oct. 9, 1984

[54] CONTAINER FOR RECEIVING RUBBISH

[75] Inventors: Ludwig Sendl, Peissenberg; Hans Singer, Unterammergau, both of Fed. Rep. of Germany

[73] Assignee: BHS Bayerische Berg-, Hutten-und Salzwerke Aktiengesellschaft, Munich, Fed. Rep. of Germany

[21] Appl. No.: 380,730

[22] PCT Filed: Oct. 20, 1981

[86] PCT No.: PCT/DE81/00176

§ 371 Date: May 10, 1982

§ 102(e) Date: May 10, 1982

[87] PCT Pub. No.: WO82/01343

PCT Pub. Date: Apr. 29, 1982

[30] Foreign Application Priority Data

Oct. 20, 1980 [DE] Fed. Rep. of Germany ..... 3039497
Aug. 25, 1981 [DE] Fed. Rep. of Germany ... 8124754[U]

[51] Int. Cl.[3] ..... B30B 15/06

[52] U.S. Cl. ..... 100/229 A; 100/295; 220/323; 220/346

[58] Field of Search ..... 100/229 A, 245, 295; 220/323, 345, 346

[56] References Cited

U.S. PATENT DOCUMENTS

| | | | |
|---|---|---|---|
| 3,129,657 | 4/1964 | Farley | 100/229 A |
| 3,229,618 | 1/1966 | O'Connor | 100/229 A |
| 3,511,176 | 5/1970 | Szaj | 100/229 A |
| 3,880,072 | 4/1975 | Ord | 100/229 A |
| 4,257,322 | 3/1981 | McDermott | 100/229 A |

FOREIGN PATENT DOCUMENTS

| | | | |
|---|---|---|---|
| 0041473 | 3/1977 | Japan | 100/229 A |
| 0077476 | 6/1977 | Japan | 100/229 A |
| 0077474 | 6/1977 | Japan | 100/229 A |
| 0018260 | 2/1978 | Japan | 100/229 A |
| 0013562 | 2/1978 | Japan | 100/229 A |
| 0030171 | 3/1978 | Japan | 100/229 A |
| 0047297 | 4/1981 | Japan | 100/229 A |

*Primary Examiner*—Wilhite Billy J.
*Attorney, Agent, or Firm*—Silverman, Cass & Singer, Ltd.

[57] ABSTRACT

The invention concerns a container (1) for receiving rubbish, with a closure plate (3) disposed on an end, which plate can be mated with a rubbish injection device (4) having a hopper (5) and a ram (6). The closure plate (3) is made in two parts, the upper part (8) limiting a free space being vertically movable, and the lower part (9) limiting the filling opening being horizontally movable. The lower part (9) of the closure plate (3) can be connected with the face (16) of the ram (6) and thus serves as a front plate of the ram (6).

19 Claims, 8 Drawing Figures

CONTAINER FOR RECEIVING RUBBISH

The invention relates to a container for receiving rubbish, with a closure plate arranged on a front end which can be fitted to a rubbish injector device provided with hopper and ram.

As the state of the art, there is already known a device for the transportation of rubbish to a rubbish recycling installation (CH-PS No. 570 315). In this known installation a container is used in which an ejector mechanism can be coupled to a discharge blade of the container. This results in a simplification of the discharge of the rubbish-filled container.

In the loading of this known container with rubbish, however, the closure plate of the container must be opened and rubbish be stuffed into the container via a ram. Here the drawback can arise that this container-filling leads to trouble, since above the ram, e.g., bulky rubbish cannot be properly introduced and must be sheared off. Further, it is difficult to close the closure plate of a filled container without rubbish sliding out of the container as a result of the withdrawal movement of the ram.

It is the problem of the present invention to so construct a container of the initially described type that a trouble-free filling in a simple manner becomes possible.

This problem is solved according to the invention as follows: The closure plate is made in two parts, the upper one, limiting a free space, being vertically movable, and the lower one, limiting the loading opening, being horizontally movable. This results in the following advantage: By means of the vertical movement of the upper part a free space is created which prevents bulky material from being subjected to a shearing action of the ram. Thus, e.g., even bulky material can be put directly into the container. Since the lower part of the closure plate is horizontally movable, it can be brought right up to the front end for the operationally correct closure of the container and then locked up with the container so that during the closure process rubbish cannot fall out again in an undesired manner.

In a further embodiment of the invention, the upper part can be constructed as a slider and be connectable with a vertically movable free space cover installed on the hopper and facing the container front end. Hereby it is possible through the movement of the free space cover, which is driven, e.g., by a hydraulically activated piston-cylinder unit, to provide a free space for the introduction of rubbish.

In a further embodiment of the invention the slider and the free space cover can be coupled to each other by way of bolts.

Another feature of the invention is that the lower part can be constructed as cover and be connected with the fact of the ram. This prevents rubbish falling out of the container again in an undesired manner upon closure of the filled container. Another feature of the invention is that the cover can have locking bolts that are connectable either with the face of the container or with the face of the ram. By way of these lock bolts the connection is easily established with either the container or with the ram.

The lock bolts can, according to another feature of the invention, be coupled to each other and moved together by means of a piston-cylinder unit. For this the lock bolts can be connected with a drive disk arranged centrally on the container face, tangentially. The rotation of the drive disk produces the locking or unlocking of the lock bolts with the corresponding counter elements.

According to another feature of the invention, a lock bolt can be connected centrally with the drive disk and on the ends by connected either with the face of the container or with the face of the ram. For this, a piston-cylinder unit is disposed on each side of the container, so that by means of the piston-cylinder units either the one or the other end of the lock bolt can be acted on. Thus, with just two piston-cylinder units the locking with the ram or the locking with the end of the container takes place.

In a further embodiment of the invention, the lower part constructed as a cover can be connected in closure position with the end of the container and in working position with the end of the ram. This results in the advantage that for the filling of the container, the lower part of the closure plate of the container is carried along as a filler element, whereupon with filled container the cover closes the container without rubbish being able to spill out of the container as a result of the withdrawal motion of the ram.

In a further embodiment of the invention, the cover can have locking bolts and coupling jaws. The locking bolts are here attached tangentially to a drive disk fastened centrically on the container fact which is angularly rotatable by way of an activating mechanism supported on the ram. This results in the advantage that the locking of the cover in closed position takes place in a simple manner, specifically with the help of a drive device supported on the ram.

According to another feature of the invention, the drive disk can have an eccentric opening in which an angularly rotatable pin of the drive device can engage. Here the drive device has a double lever supported centrically to the ram whose one end is connected to a piston-cylinder unit, and whose other end holds the pin. By way of this piston-cylinder unit the pin can rotate through a certain angle and as a result of its engagement in the drive disk a locking or unlocking of the cover takes place.

In a further embodiment of the invention, the ram can have coupling elements that can engage on the end with the coupling jaws of the container cover. These coupling elements consist each of an angularly rotatable bolt with front flange engageable in the corresponding coupline jaw. Each bolt can be activated by a piston-cylinder unit and is carried inside a sleeve with a guide slot, with a pin connected with the bolt running in the guide slot. By means of this coupling between the container cover and the ram, which is quickly and easily carried out, the container can be connected correctly with the ram and be used itself as a front plate in the filling of the container with rubbish, so that after completion of the filling and closing of the cover no more rubbish can spill out of the container.

The invention is described in greater detail below using the embodiment examples shown in the drawings. In the drawings, FIG. 1 shows a schematic side view of the container and the rubbish injection device in cross section;

Figure 1:
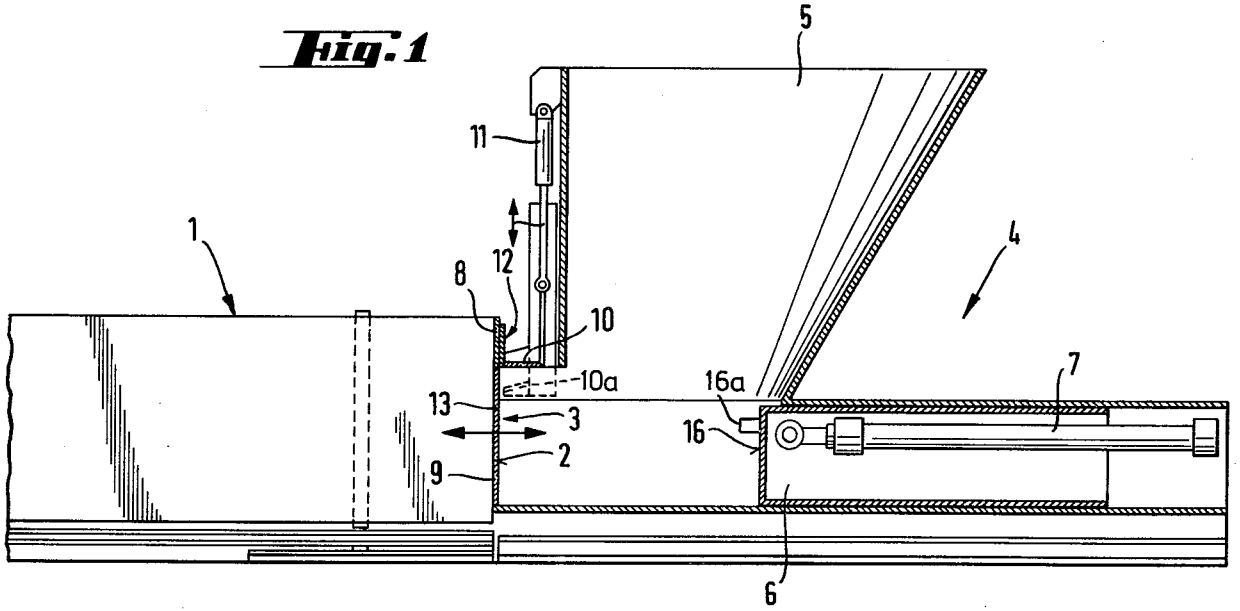

In FIG. 1 an empty container 1 has been attached to a rubbish injector device for filling with rubbish. Here the front 2 of the container 1 is opened in such a way that rubbish poured in via a hopper 5 can be introduced into the container with the help of ram 6.

Figure 2:
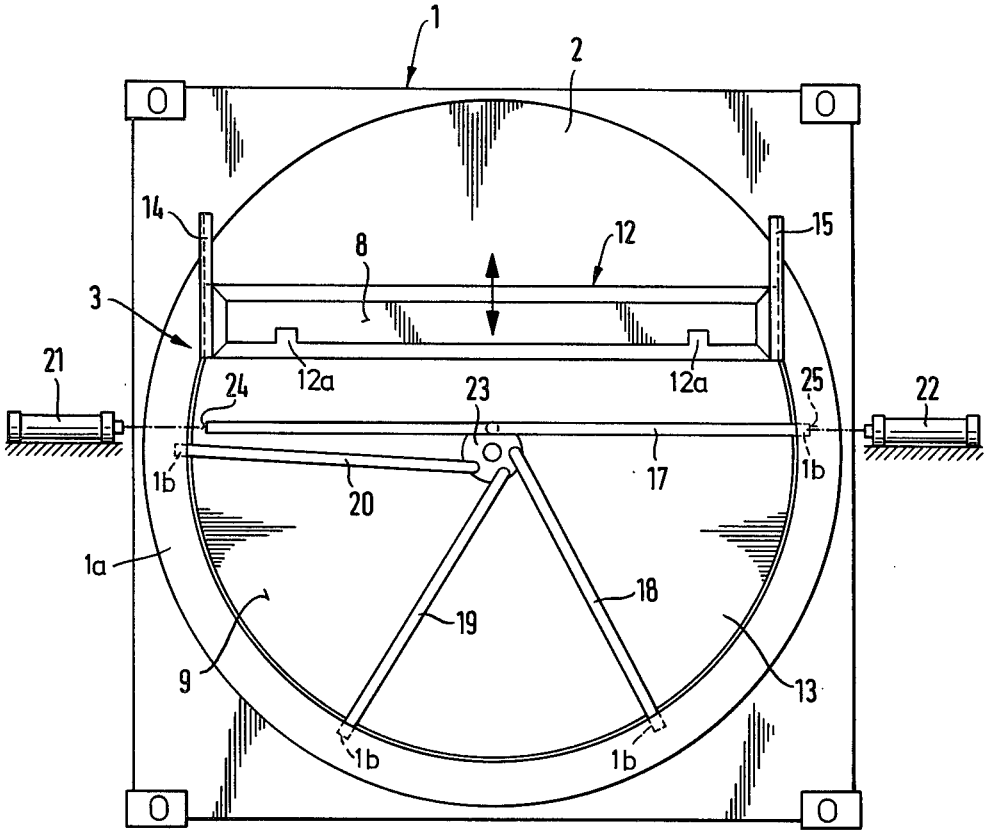
FIG. 2 shows a front view of the container of FIG. 1.

In FIG. 2 the front face 2 of the container 1 has a closure plate 3 which is made in two parts, with an upper part 8 and a lower part 9. The upper part 8 also forms part of a slider 12 which is vertically movable in the two guideways 14 and 15.

In FIG. 1, also, the hopper 5 has on its side facing the end face 2 of the container a vertically movable free space cover 10. This free space cover 10 is connected with a hydraulically activated piston-cylinder unit 11.

In order to make possible the trouble-free filling of the container 1, a free space is necessary over the ram 6. By means of this free space a shearing edge between upper edge of the ram and lower edge of the filler hopper 5 is avoided. After the filling process, both the cross section of the ram 6 and the cross section of the free space must be closed. Accordingly the slider 12 can glide in the guideways 14 and 15. This slider 12 supported on the container front is moved by the free space cover 10. When the container 1 is coupled to the rubbish injection device 4 two 10*a* on cover 10 engage in holes 12*a* in the slider 12. This enables this slider 12 to be moved together with free space cover 10.

Before the last filling stroke of the ram 6, the free space cover 10 is pressed downward together with the slider 12 of the container 1. This makes it possible for all the rubbish that is in the ramming throat to be pushed into the container 1 and for no rubbish to get jammed in the container closure. By means of the connection of the free space cover 10 with the slider 12, the desired free space for the problem-free filling of the container 1 with rubbish can be easily provided.

In FIG. 2 the lower part 9 of the closure plate 3 of the container 1 is constructed as a cover 13 and connectable with the end 16 (FIG. 1) of the ram 6. For this, as shown in FIG. 2, the cover 13 has on its front side a number of lock bolts 17, 18, 19, 20 which move into and out of holes 1*b* in the side wall 1*a* of the container 1. These lock bolts are attached to an activating plate 23 which is installed centrally on the lower part 9 of the cover 13. The lock bolts 17, 18, 19 and 20 are attached tangentially to the activating plate 23.

On either side of the container 1 there are installed 2 piston-cylinder units 21 and 22. If, e.g., as shown in FIG. 2, the piston-cylinder unit 22 operates, it acts on the end 25 of the lock bolt 17, resulting in a rotation of the activating disk 23 through a certain degree of angle counter-clockwise, causing the unclocking of the cover 13 from the front 2 of the container 1 and then the locking with the face 16 of the ram 6 by suitable coupling means 16*a* on the face 16 as illustrated representatively in FIG. 1.

The filler opening in the container face 2 is the same size as the cross section of the ram and is closed by the cover 13 provided with the lock bolts 17, 18, 19 and 20. When the container 1 is coupled to the rubbish injection device 4, the lock bolts 17, 18, 19 and 20 are released by the hydraulic cylinder unit 22 from the face 2 of the container 1 and coupled to the face of the ram 6.

Now, with the help of the piston-cylinder unit 7 shown in FIG. 1, rubbish can be put into the container 1 via the hopper 5 by means of the back-and-forth movement of the ram 6.

After the last filling stroke, the ram 6 and the container face 2 are brought up for closure. By means of the second piston-cylinder unit 21, the connection between the ram 6 and the cover 13 is again undone and the locking between the cover 13 and face 2 of the container established. Thus we have a container 1 filled with rubbish without any problems, having avoided the undesirable spilling of rubbish out of the container after the last filling stroke.

Figure 3:
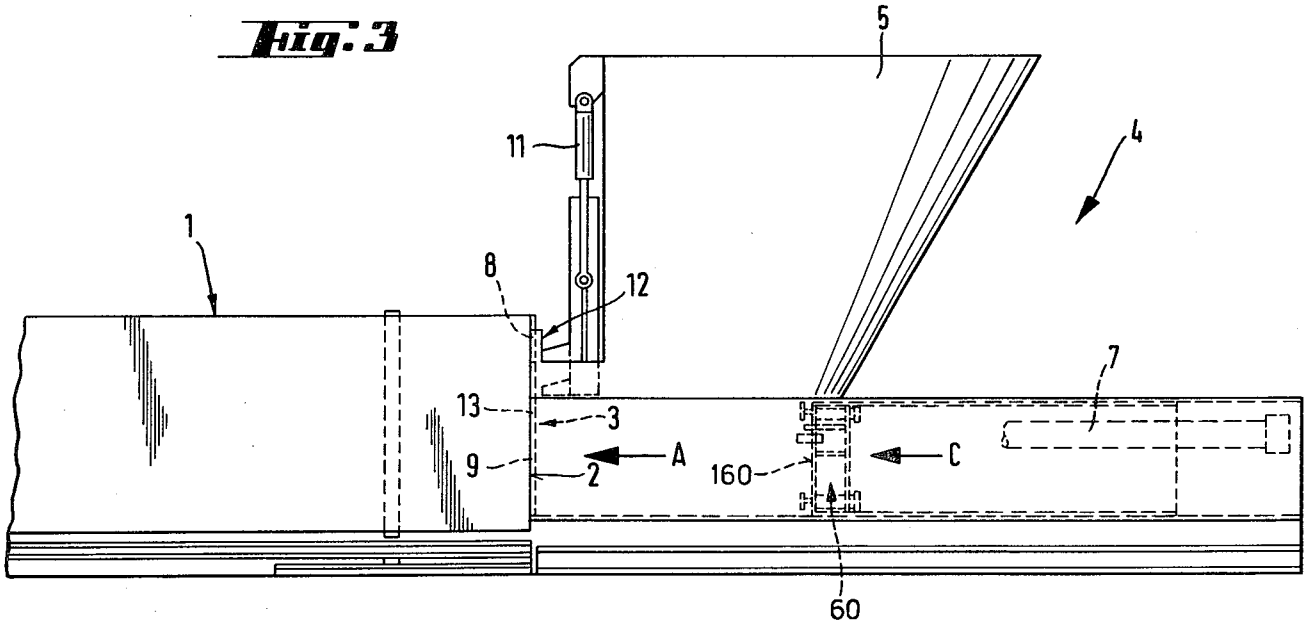
FIG. 3 shows another embodiment of the invention in schematic side view of a container for receiving rubbish, with rubbish injection device.

In FIG. 3 another embodiment example of the invention is shown. Again an empty container 1 is mated to a rubbish injection device for filling. Here the face 2 of the container 1 is so opened that rubbish dumped in through hopper 5 is pushed into the container 1 by means of the ram 60. The face of the container is made in two parts, with the upper part 8, which is vertically movable, and the lower part 9. This lower part 9 of the closure plate 3 of the container 1 is again constructed as a cover and is connectable with the face 160 of the ram 6.

Figure 4:
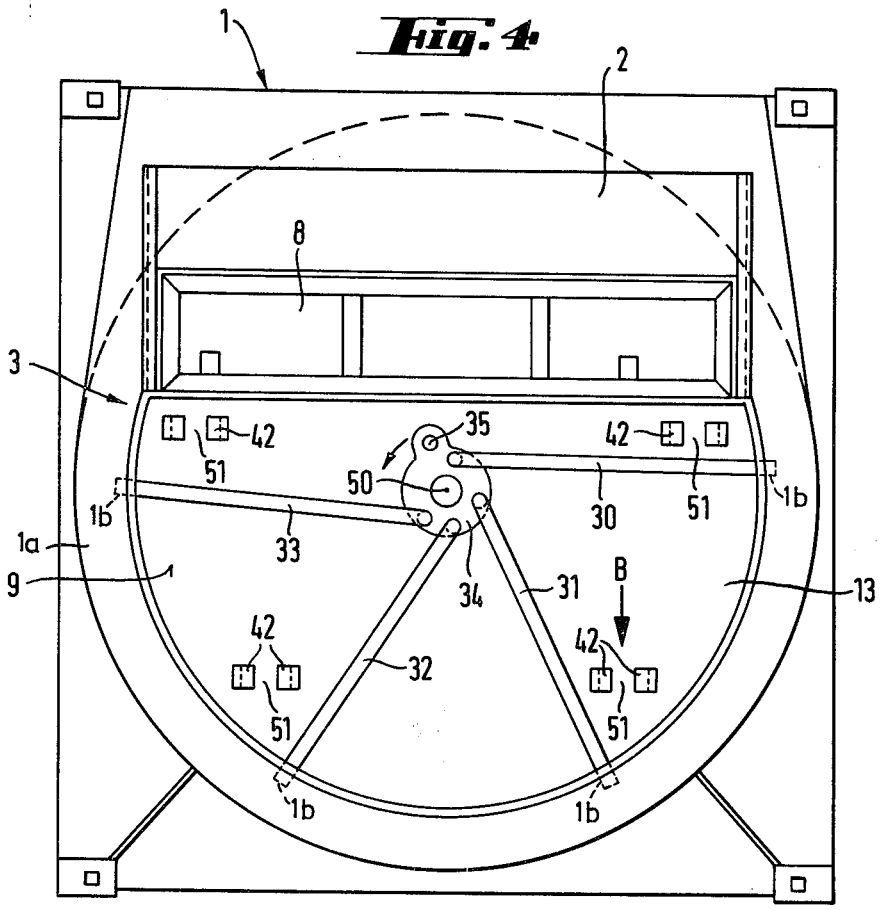
FIG. 4 shows a view in the direction of the arrow A in FIG. 3.

As shown in FIG. 4, the cover 13 has on its face a number of lock bolts 30, 31, 32 and 33. These lock bolts are fastened tangentially to an activating disk 34 installed on the container face 2. The activating disk 34 has an eccentric hole 35 and is rotatable around its center 50.

If, now, this activation disk 34 is rotated around its center point 50, e.g., counter-clockwise by a certain angular amount, then the not further-represented joints of the individual ends of the lock bolts 30, 31, 32 and 33 move in a circle, causing the aforementioned lock bolts to slide out of their recesses in the container, thereby unlocking the closure plate 3, i.e., the container cover 13. If, on the other hand, the activating disk 34 is moved clockwise a certain angular amount, then the individual lock bolts 30 31, 32 and 33 are pushed back into the corresponding holes in the container 1, which results in the closure of this container.

Figure 7:
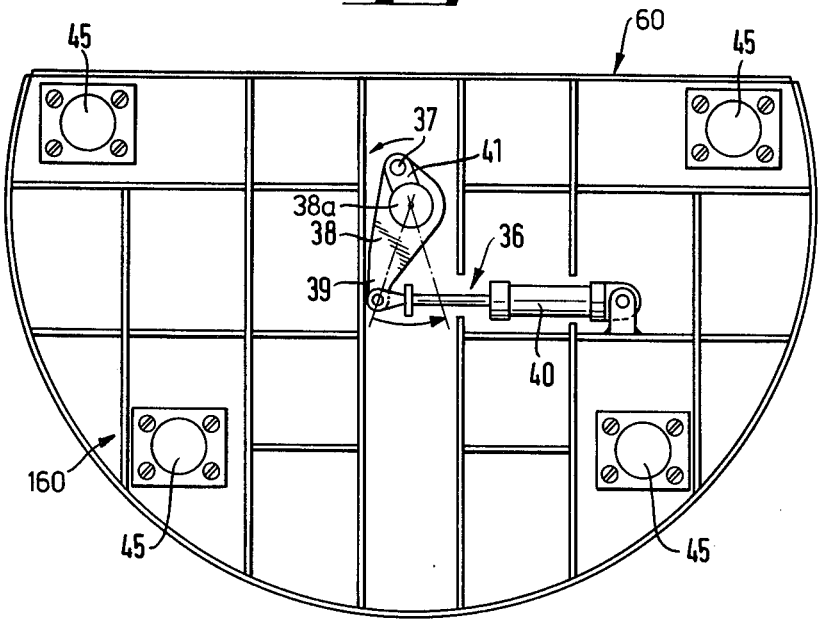
FIG. 7 shows a view in the direction of arrow C of FIG. 3.
Figure 6:
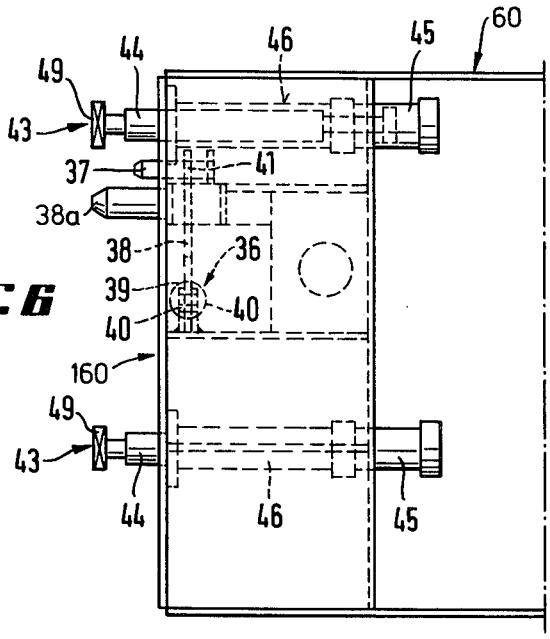
FIG. 6 shows a side view of the front end face of the ram.

For the rotation of the activating disk 34, as shown in FIGS. 6 and 7 the ram 60 has in its front part an activating device 36. This activating device 36 consists of a piston-cylinder unit 40 whose piston rod is connected to the lower end 39 of a two-part lever 38. The upper end 41 of the two-part lever has a pin 37. If now, in the situation represented in FIG. 7, the piston-cylinder unit 40 is so activated that the piston rod slides into the cylinder, then the two-armed lever 38 pivots in the counterclockwise direction.

The design, as illustrated in FIGS. 4, 6 and 7, is such that when the ram 60 comes up to the container cover 13, the pin 37 of the activating device 36 slides into the opening 35 of the activating disk 34 and is lodged therein guided by insertion of the centering pin 38*a* of lever 38 into the center 50 of the disk 34. If now the piston-cylinder unit 40 is activated in the afore-mentioned direction, then, as already described, the piston-cylinder unit 40 rotates the two-armed lever 38 in the counterclockwise direction, causing the activating disk 34 also to turn counterclockwise and thereby the lock bolts 30, 31, 32 and 33 to pull their front ends out of the openings in the container 1 with the corresponding axial movement and thus to undo the locking.

By means of this design it is advantageously possible to carry out in a simple manner the locking or unlocking of the container cover 13 with respect to the container 1.

Figure 5:
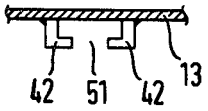
FIG. 5 shows a view in the direction of the arrow B in FIG. 4.

In order, now, to connect the ram 60 with the container cover 13 for the carrying out of the filling of the container 1, as shown in FIGS. 4 and 5 the container cover has four jaws 42. These jaws each consist of angle pieces and are fastened to the face of the container cover 13.

As shown in FIGS. 6 and 7, the ram 60 has in the same arrangement four piston-cylinder units 45 which are each provided on their front ends with coupling elements 43. Each of these coupling elements consists of a bolt 44 with an end flange 49. If, now, with the ram 60 pushed forward, the end flange 49 of the coupling elements 43 is rotated, e.g., 90° in the area of the coupling jaws, each flange 49 engages behind the coupling jaw 42, producing a coupling between container cover 13 and the ram 6.

Figure 8:
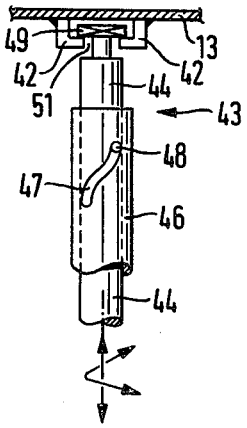
FIG. 8 shows an individual representation of the coupled elements.

In order to execute the angular rotation of the bolts 44 with the front flanges 49, each coupling bolt is carried inside a sleeve 46. This sleeve has, as shown in FIG. 8, a guide slot 47. In this guide slot 47 a pin 48 connected with the bolt 44 can slide.

If now, for example, according to FIG. 8, by means of the activation of the particular piston-cylinder units 45 bolt 44 is pushed forward against the container cover 13, the pin 48 slides in the guide slot 47 from lower left to upper right end position, whereby a rotation of the bolt 44 necessarily results in the direction of the arrow shown in FIG. 8 and therewith the flange 49 slides behind the respective area of the coupling jaws 42.

The flange 49 is preferably rectangular, because its narrower area is able to pass between the opening 51 of the coupling jaws 42. After rotation of the rectangular flange 49 by, e.g. 90°, the length of the flange 49 is such that it engages behind the coupling jaw as shown in FIG. 8 and thus a coupling effect is achieved. By means of reverse stroke movement of the piston-cylinder units 45, the bolt 44 rotates in the opposite direction, resulting in the unlocking between the ram 6 and the closure cover 13 of the container.

The operation of the container in the embodiment according to FIGS. 3 to 8 is described in greater detail below:

First, as previously described by bringing the ram face 160 up to the closure cover 13 the pin 37 is lodged in the opening 35 of the activating disk. Then, by way of the activating device 36 shown in FIG. 7, the two-armed lever 38 is moved in the counterclockwise direction, resulting in the unlocking of the cover 13 of the container in the afore-described manner by means of the lock bolts 30, 31, 32 and 33.

Simultaneously, the piston-cylinder units 45 are activated, causing the coupling of the bolts 44 with their flanges 49 in the corresponding coupling jaws 42 of the container cover 13. Now the container cover 13 constitutes the front plate of the ram 6 and can be withdrawn with it. The filling of the container 1 is carried out via the hopper 5, the rubbish being compressed in the container 1.

If the container 1 is filled with compressed rubbish, then the activating device 36 is activated and it rotates the two-armed lever 38 shown in FIG. 7 in the clockwise direction, causing the locking of the container cover 13 with the container 1 by means of the lock bolts 30, 31, 32 and 33.

Simultaneously, the piston-cylinder units 45 as shown in FIG. 6 are also activated, causing the corresponding bolts to retract and at the same time to rotate by a certain degree of angle, so that the flanges 49 emerge from the effective area of the coupling jaws 42 and uncoupling results. The container is thus completely filled with rubbish and can be taken away.

We claim:

1. A container for receiving rubbish and for mating with a rubbish injector device provided with a hopper and a ram, said container comprising a closure plate for closing an opeing at one end of said container through which the rubbish is received, wherein the closure plate includes:

A. a vertically movable upper part for removably closing an upper area of the container opening to be maintained open above the ram when rubbish is injected into the container by the ram; and B. a horizontally movable lower part for removably closing a lower area of the opening through which the rubbish is injected by the ram.

2. The container of claim 1 in which said upper part is slidable in a vertical motion and is removably connected to a vertically movable cover member disposed on said hopper and aligned with said upper part for covering said upper area of said container opening.

3. The container of claim 2 wherein said cover member is connected to a hydraulically activated piston-cylinder unit.

4. The container of claim 3 wherein said upper part of said plate and said cover are connected to each other by bolts.

5. The container of claim 1 wherein said lower part of said plate is removably connected to a face formed on said ram.

6. The container of claim 5 wherein said lower part of said plate includes a plurality of lock bolts being removably connected to either said container for closing said opening, or to said face of said ram for injecting said rubbish.

7. The container of claim 6 wherein said lock bolts are interconnected for tandem movement thereof.

8. The container of claim 1 further including an activating disk mounted on said lower part and generally centrally located on said plate, said disk having a plurality of lock bolts connected to said disk for activating locking of said bolts.

9. The container of claim 8 wherein said lock bolts are connected tangentially on the activating disk.

10. The container of claim 8 wherein a middle portion of one of said lock bolts is connected to said activating disk, said bolt having opposing ends formed thereon, one of said respective ends being removably connected to either said container for closing said opening, or to said face of said ram for injecting said rubbish.

11. The container as claimed in claim 10 further including a pair of piston-cylinder units for alternative, removable engagement with said respective ends of said bolt.

12. The container of claim 1 wherein said lower part of said plate is removably connected to either said container for closing said opening, or to said face of said ram for injecting said rubbish.

13. The container of claim 12 wherein said lower part of said plate includes a plurality of lock bolts, said lower part further including jaws for said removable connection of said lower part to said face of said ram.

14. The container of claim 13 removably connected to said ram, and further including an activating disk mounted on said lower part and generally centrally located on said plate, said lock bolts being connected tangentially on said activating disk, said face of said ram including activating means for angular rotation of said disk in order to removably connect said lock bolts to said container.

15. The container of claim 14 wherein said activating means comprises a drive pin removably inserted into an eccentric opening formed in said disk for angular rotation thereof for said removable connection of said lock bolts to said container.

16. The container of claim 15 wherein said activating means includes a double lever having one end on which said pin is mounted, and having a second end connected to a piston-cylinder unit.

17. The container of claim 13 removably coupled to said ram having coupling means for coupling to said jaws.

18. The container of claim 17 wherein said coupling means comprises an angularly rotatable bolt having a flange extending therefrom engaged within said jaws.

19. The container of claim 17 wherein said coupling means comprises an angularly rotatable bolt reciprocated within a sleeve by a piston-cylinder unit, said sleeve having a guide slot through which a guide pin connected to said bolt is guided during said reciprocation to produce rotation of said bolt, said bolt having a flange projecting therefrom for removable engagement with said jaws by said rotation.

* * * * *